US006859510B1

(12) United States Patent
Ishida

(10) Patent No.: US 6,859,510 B1
(45) Date of Patent: Feb. 22, 2005

(54) ELECTROMAGNETIC COUNTER WITH BUILT-IN ILLUMINATION DEVICE

(75) Inventor: Noriyuki Ishida, Tokyo (JP)

(73) Assignees: Contex Corporation, Tokyo (JP); Tokyo Keisu Industry Co., Ltd., Tokyo (JP)

( * ) Notice: Subject to any disclaimer, the term of this patent is extended or adjusted under 35 U.S.C. 154(b) by 0 days.

(21) Appl. No.: 10/798,298

(22) Filed: Mar. 12, 2004

(30) Foreign Application Priority Data

Feb. 3, 2004 (JP) ..... 2004-026803

(51) Int. Cl.[7] ..... G06M 1/10

(52) U.S. Cl. ..... 377/82; 377/89; 235/1 B; 235/103; 324/234; 324/239; 324/240; 324/244.1; 324/260

(58) Field of Search ..... 377/82, 89; 235/1 B, 235/103; 324/234, 239, 240, 244.1, 260

(56) References Cited

U.S. PATENT DOCUMENTS 3,814,908 A * 6/1974 Wakabayashi ..... 377/87
4,260,878 A * 4/1981 Kawamura et al. ..... 377/13
5,578,807 A * 11/1996 Tsukakoshi ..... 235/95 R
6,754,445 B2 * 6/2004 Nakata ..... 396/54

* cited by examiner

*Primary Examiner*—Margaret R. Wambach
(74) *Attorney, Agent, or Firm*—Manabu Kanesaka

(57) ABSTRACT

An electromagnetic counter includes a case, an electromagnet, an anchor rotatable through magnetization and demagnetization of the electromagnet, and number wheels rotated by a predetermined angle according to the rotation of the anchor. A flexible board with a light emitting diode is disposed in a confined space in the case for illuminating the number wheels.

6 Claims, 7 Drawing Sheets

ELECTROMAGNETIC COUNTER WITH BUILT-IN ILLUMINATION DEVICE

BACKGROUND OF THE INVENTION AND RELATED ART STATEMENT

The present invention relates to an electromagnetic counter and, more particularly, relates to an improvement of an illumination mechanism of an electromagnetic counter installed in a device.

Conventionally, as disclosed in, for example, patent reference 1, there has been known an electromagnetic counter provided with at least an electromagnet, an anchor rotatable through magnetization and demagnetization of the electromagnet, and a lowest digit number wheel having a ratchet gear on a side thereof for engaging a tab formed at an end of the anchor. The electromagnetic counter also includes a predetermined number of upper digit number wheels having transmission gears on sides thereof, and pinions disposed between the number wheels for increasing figures.

In the electromagnetic counter, the electromagnet, anchor and number wheels are disposed inside a case to keep an iron core magnetized by the electromagnet away from iron paticles so that the anchor rotates smoothly. For example, a frame member with the electromagnet, anchor and number wheels arranged at predetermined locations is covered with a box-shaped cover member.

Patent reference 1; Japanese Patent Publication (Kokai) No. 57-93487.

The electromagnetic counter is installed in various types of equipment such as a game machine, a copy machine or a printer for counting, for example, coins or sheets of paper. In many cases, the electromagnetic counter is installed inside the equipment. Since the inside of the equipment is dark and the counter is not provided with a light emitting function, it is difficult to read a number displayed on the counter. In such a case, it may be necessary to illuminate the inside of the equipment with a flashlight to read a number.

In order to resolve the problem, a separate illumination lamp may be installed inside the equipment for illuminating the number wheels, or a small light bulb may be disposed inside the counter. Recently, as the size of the equipment in which the electromagnetic counter is installed has been decreased, the size of the electromagnetic counter has been reduced as well. Accordingly, it is extremely difficult to install an illumination lamp inside the equipment or the electromagnetic counter. Further, even if it is arranged to provide a confined space for installing a miniature light bulb, it is necessary to periodically replace the light bulb due to the limited service life of the filament of the light bulb, thereby increasing maintenance work and cost due to the confined space. In a case of an electromagnetic counter in which an electromagnet, anchor and number wheels are disposed in a housing and a cover member is fixed to a frame member, it is essentially impossible to replace a light bulb, so that the entire electromagnetic counter needs to be replaced.

In view of the problems described above, the present invention has been made, and an object of the present invention is to provide an electromagnetic counter with built-in illumination means disposed in an extremely narrow space within a compact electromagnetic counter, resulting in minimum maintenance and reduced cost.

Further objects and advantages of the invention will be apparent from the following description of the invention.

SUMMARY OF THE INVENTION

In order to achieve the objects described above, according to a first aspect of the present invention, an electromagnetic counter includes a case, an electromagnet, an anchor rotatable through magnetization and demagnetization of the electromagnet, number wheels rotating by a predetermined angle according to the rotation of the anchor, and a flexible board with a light emitting diode disposed in a confined space of the case for illuminating the number wheels.

According to a second aspect of the present invention, the case is composed of a frame member with the electromagnet, anchor and number wheels mounted thereon, and a cover member for covering the frame member. The confined space is formed between the frame member and the cover member, and the flexible board is disposed in the confined space.

According to a third aspect of the present invention, an electromagnetic counter includes a frame member, a box-shaped cover member for covering the frame member, an electromagnet disposed in the frame member, an anchor disposed in the frame member and rotatable through magnetization and demagnetization of the electromagnet, and number wheels disposed in the frame member and rotating by a predetermined angle according to the rotation of the anchor. The frame member is provided with a notch formed in a surface thereof for receiving a light emitting diode that illuminates the number wheels, and a flexible board with the light emitting diode is attached to the surface of the frame member. An adhesive tape or double-sided tape can be used to attach the flexible board to the composite surface of the frame member. A double-sided tape is preferable in view of workability, production cost and the like.

According to a fourth aspect of the present invention, the cover member has an opening for inserting the frame member. The frame member is formed in a roughly U-shape, and has a base section closing the opening and side sections extending from left and right sides of the base section. The electromagnet, anchor and number wheels are arranged between the left and right side sections. A connection terminal of the electromagnet protrudes outwardly through the base section, and is fixed to a circuit board provided in equipment in which the electromagnetic counter is installed. The flexible board is attached to the side section of the frame member. An end section of the flexible board protrudes outside the base section. An end terminal section of a printed wiring connected to the light emitting diode is formed at the end section of the flexible board, so that the end terminal section is soldered to a wiring of the circuit board.

According to a fifth aspect of the present invention, in the electromagnetic counter according to the third aspect, in which the cover member has an opening for inserting the frame member, and the frame member is formed in a roughly U-shape and has a base section closing the opening and side sections extending from left and right sides of the base section, the electromagnet, anchor and number wheels are arranged between the left and right side sections. The flexible board is attached to the side section. A groove is provided in the frame member for engaging an end section of a lead wire connected to a printed wiring of the flexible board. The end section of the lead wire engaging the groove is soldered to an end terminal section of the printed wiring.

According to a sixth aspect of the present invention, the light emitting diode is a multicolor light emitting diode.

In the present invention, the number of the number wheels is not limited. A typical configuration includes a lowest digit number wheel rotating by a predetermined angle according to a rotation of an anchor, a predetermined number of upper digit number wheels having transmission gears on sides thereof, and pinions interposed between the number wheels for increasing figures. Such a typical configuration is applicable to the present invention.

In the present invention, the configurations described above are employed, thereby obtaining the following effects. In the first aspect of the present invention, the light emitting diode mounted on the flexible board is built in as the illumination means of the counter display section. Accordingly, it is easy to install the illumination means even in the confined space within the compact electromagnetic counter. Further, the light emitting diode does not use a filament, resulting in minimum maintenance as compared with a miniature light bulb. When the electromagnetic counter is installed in equipment, the circuit wiring or a lead wire of the equipment is simply connected to the end terminal section of the printed wiring formed on the flexible board to complete the installation, so that the electromagnetic counter with built-in illumination means is extremely useful for installing in a compact game machine, a copier, a printer and the like.

In the second aspect of the present invention, the cover member covers the frame member provided with the counter constituent elements such as the electromagnet, anchor and number wheels. Accordingly, the electromagnetic counter has superior dust resistance, and is easy to assemble and reduce in size. The confined space between the frame member and cover member is effectively utilized. Accordingly, the electromagnetic counter with built-in illumination means has superior reliability in the counting operation, and can be manufactured at low cost, thereby obtaining high product value.

In the third aspect of the present invention, the flexible board with the light emitting diode is attached to the frame member. Accordingly, it is easy to install the illumination means. Further, the notch is formed in the surface of the frame member, so that the light emitting diode can be attached at a thick wall portion of the frame member. Accordingly, it is not necessary to provide an additional space for the illumination means, thereby obtaining the effects described above.

In the fourth aspect of the present invention, when the electromagnetic counter is installed in the equipment, the installation is completed with a simple process of soldering the circuit wiring of the equipment to the end terminal section at the end of the flexible board protruding outside, and inserting the connection terminal of the electromagnet into the wiring board. Accordingly, in addition to the effects described above, the electromagnetic counter is extremely useful for various types of equipment such as a compact game machine, a copier and a printer.

In the fifth aspect of the present invention, the end section of the lead wire connected to the printed wiring of the flexible board engages the groove formed in the frame member. Accordingly, in addition to the effects described above, even when a force is applied in a direction of pulling out the lead wire, the force is applied directly to the soldered section of the lead wire and the printed wiring, thereby preventing the lead wire from being pulled out and improving the reliability of the illumination means in which the lead wire is connected.

In the sixth aspect of the present invention, the multicolor light emitting diode is used, so that it is possible to arbitrarily select a color of the emitted light. Accordingly, in addition to the effects described above, when a plurality of electromagnetic counters is installed to accommodate a plurality of count elements, it is possible to change the color of the emitted light for each electromagnetic counter, thereby reducing reading error of the count elements.

DETAILED DESCRIPTION OF PREFERRED EMBODIMENTS

Hereunder, embodiments of the present invention will be explained with reference to the accompanying drawings. An electromagnetic counter of the present invention is not limited to the embodiments.

Figure 1A:
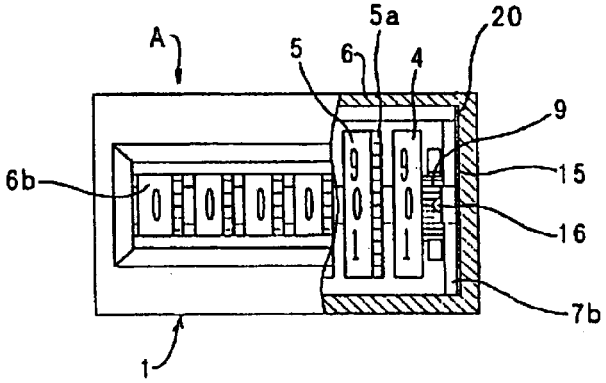
FIGS. 1(*a*) to 1(*c*) are views showing an electromagnetic counter according to an embodiment of the present invention, wherein FIG. 1(*a*) is a partial cut front view thereof, FIG. 1(*b*) is a partial cut plan view thereof, and FIG. 1(*c*) a cross sectional view taken along line 1(*c*)—1(*c*) in FIG. 1(*b*)
Figure 1B:
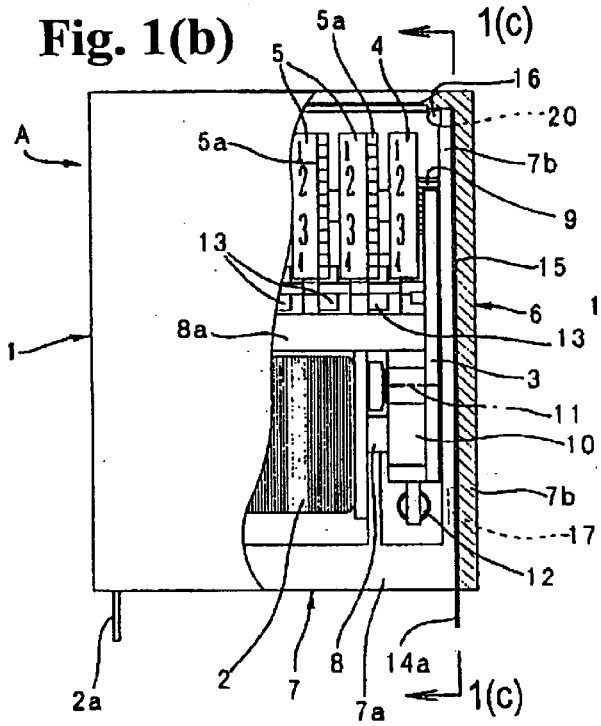
Figure 1C:
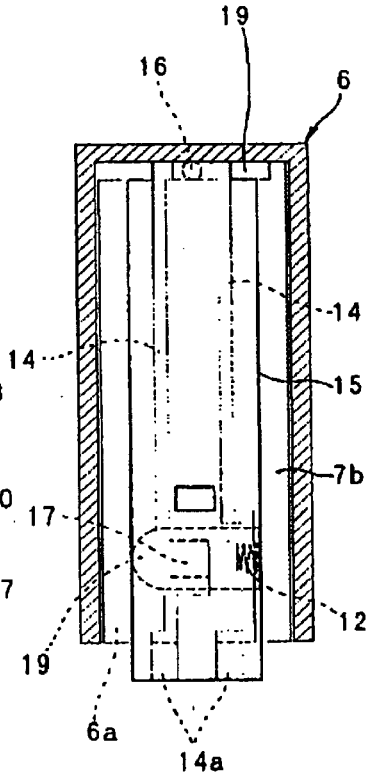

As shown in FIGS. 1(*a*)–1(*c*) and 2(*a*), 2(*b*), an electromagnetic counter A is provided with an electromagnet 2, an anchor 3, a lowest digit number wheel 4, upper digit number wheels 5 and an illumination means inside a case 1. The illumination means illuminates the number wheels 4 and 5, so that displayed numbers can be easily read even in a dark location.

The case 1 is composed of a roughly box-shaped cover member 6 and a frame member 7 with a periphery thereof covered by the cover member 6. The cover member 6 is provided with an opening 6*a* as an insertion hole for the frame member 7 on an arbitrary side (e.g., backside) and a window 6*b* as a counter display section on another arbitrary side (e.g., front side). The frame member 7 has a roughly U-shape in which a base section 7*a* closes the opening 6*a* and side sections 7*b* extend at left and right sides of the base sections 7*a*. The electromagnet 2, anchor 3, lowest digit number wheel 4, and upper digit number wheels 5 are arranged between the side sections 7*b* at the left and right sides of the frame member 7 to compose an electromagnetic counting mechanism.

The electromagnetic counting mechanism is composed in the same manner as a conventional electromagnetic counter. When a current is supplied to the electromagnet 2, an iron core 8 and auxiliary iron core 8*a* are magnetized. The anchor 3 is provided with a movable piece 10 integrated with a base end thereof and a tab at a distal end thereof for engaging a ratchet gear 9. The movable piece 10 is attracted by the iron core 8 and auxiliary iron core 8*a*, and the anchor 3 rotates in the forward direction around a rotation axis 11 against a spring 12. When the current to the electromagnet 2 is interrupted, the iron core 8 and auxiliary iron core 8 are no longer magnetized. Accordingly, the anchor 3 rotates in the reverse direction due to the spring 12. That is, the anchor 3 makes one rotation when the current to the electromagnet 2 is switched on and off, and the ratchet gear 9 rotates by 36 degrees. The ratchet gear 9 is integrated with the lowest digit number wheel 4, so that the lowest digit number wheel 4 also rotates 36 degrees according to the rotation of the ratchet gear 9. Numbers from "0" to "9" are printed on an outer periphery of the lowest digit number wheel 4 at a 36 degree interval. The lowest digit number wheel 4 rotates each time a pulse of signal current is applied to the electromagnet 2. The upper digit number wheels 5 are arranged in a row along with the lowest digit number wheel 4, and have transmission gears 5*a* on their sides and pinions 13 for increasing figures between the number wheels 4 and 5. When the lowest digit number wheel 4 makes one rotation, the pinion 13 also rotates, and the adjacent upper digit number wheel 5 rotates by 36 degrees. When the adjacent upper digit number wheel 5 makes one rotation, the pinion 13 rotates and the next upper digit number wheel 5 rotates by 36 degrees, thereby counting the number of the signals applied to the electromagnet through repeating the operation.

In the illumination means, a printed wiring 14 is formed on a flexible board 15, and a light emitting diode 16 and a current limiting resistor 17 are mounted on the flexible board 15. The flexible board 15 is attached to one of the side sections 7*b* at the left and right sides of the frame member 7 with double-sided tapes 18 (right side in FIG. 1(*b*)). Notches 19 are formed at suitable locations in the side section 7*b* to which the flexible board 15 is attached, and the light emitting diode 16 and current limiting resistor 17 are housed in the notches 19, so that the illumination means is disposed within a confined space 20 between the cover member 6 and the frame member 7.

An end section of the flexible board 15 protrudes outside the base section 7*a* of the frame member 7 (protrudes outside the case 1). End terminal sections 14*a* of the printed wiring 14 are formed on the end section. When voltage is applied to the end terminal sections 14*a*, a current flows to the light emitting diode 16 through the current limiting resistor 17 to illuminate, and the light is radiated towards each of the number wheels 4 and 5, so that the count can be read even in a dark location. Connection terminals 2*a* of the electromagnet 2 pass through the base section 7*a* of the frame member 7 and protrude outside the case 1.

Figure 3:
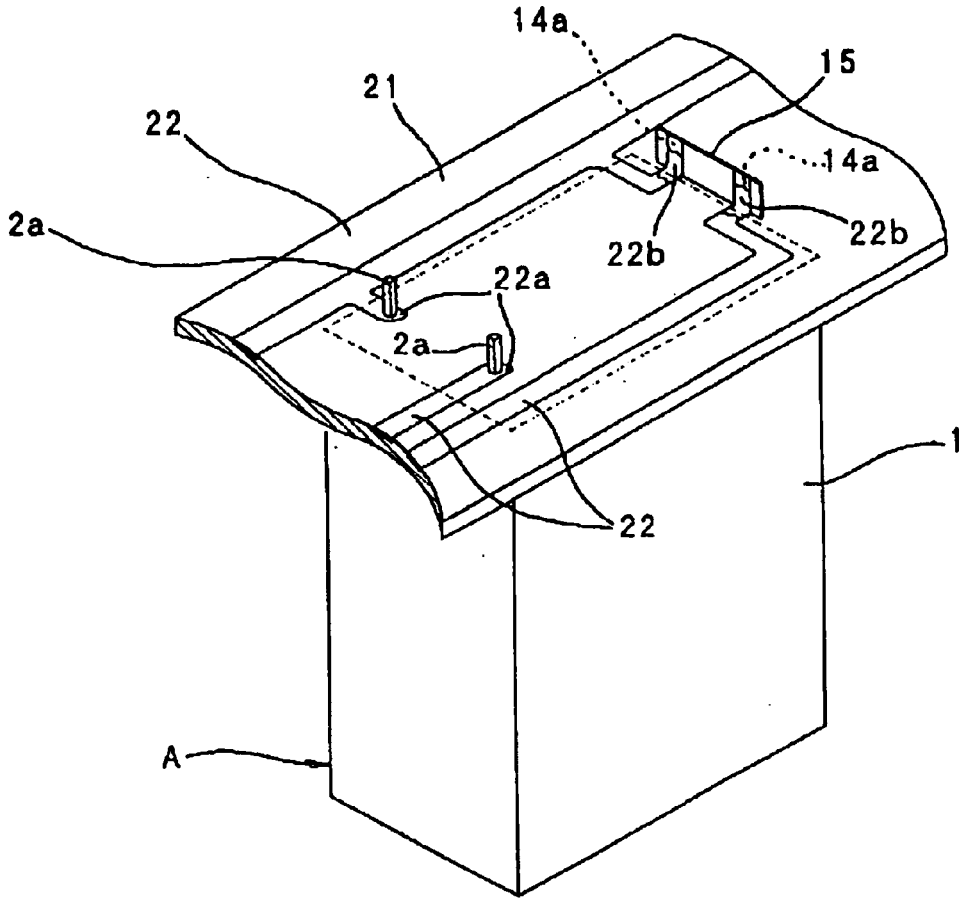
FIG. 3 is a perspective view showing a state in which the electromagnetic counter shown in FIGS. 1(*a*)–1(*c*) is mounted on a circuit board.

FIG. 3 shows a state in which the electromagnetic counter A of the present embodiment is attached to a circuit board 21 provided in equipment. Wirings 22 are formed on the circuit board 21 for supplying electrical power to the electromagnet 2 and light emitting diode 16. Inserts 22*a* are formed at suitable locations on the wirings 22 for inserting the connection terminals 2*a* of the electromagnet 2, and connectors 22*b* are formed at suitable locations on the wirings 22 to be connected to the end terminal sections 14*a* of the flexible board 15. The end terminal sections 14*a* are soldered to the connectors 22*b*, and the connection terminals 2*a* of the electromagnet 2 are inserted into the inserts 22*a* to be soldered. Accordingly, it is possible to connect the wirings 22 of the circuit board 21 to the electromagnet 2 and light emitting diode 16, and install the electromagnetic counter A in the equipment in the same step, thereby simplifying the assembly process.

Figure 2A:
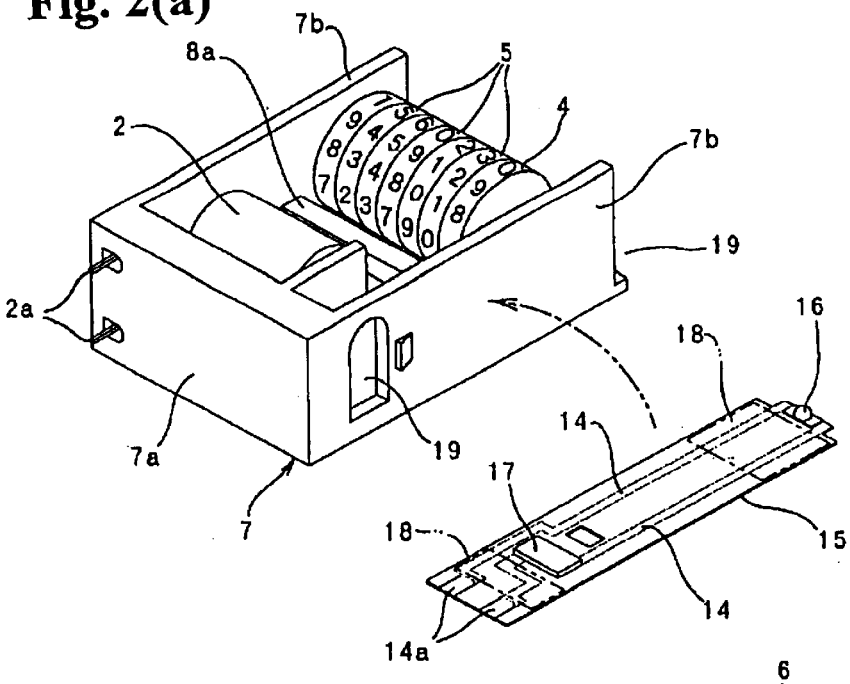
FIGS. 2(*a*) and 2(*b*) are views showing the electromagnetic counter, wherein FIG. 2(*a*) is a perspective view of a state in which, a cover member and a flexible board of the electromagnetic counter shown in FIGS. 1(*a*) to 1(*c*) are removed, and FIG. 2(*b*) is a perspective view showing a state before the cover member and frame member are assembled.
Figure 2B:
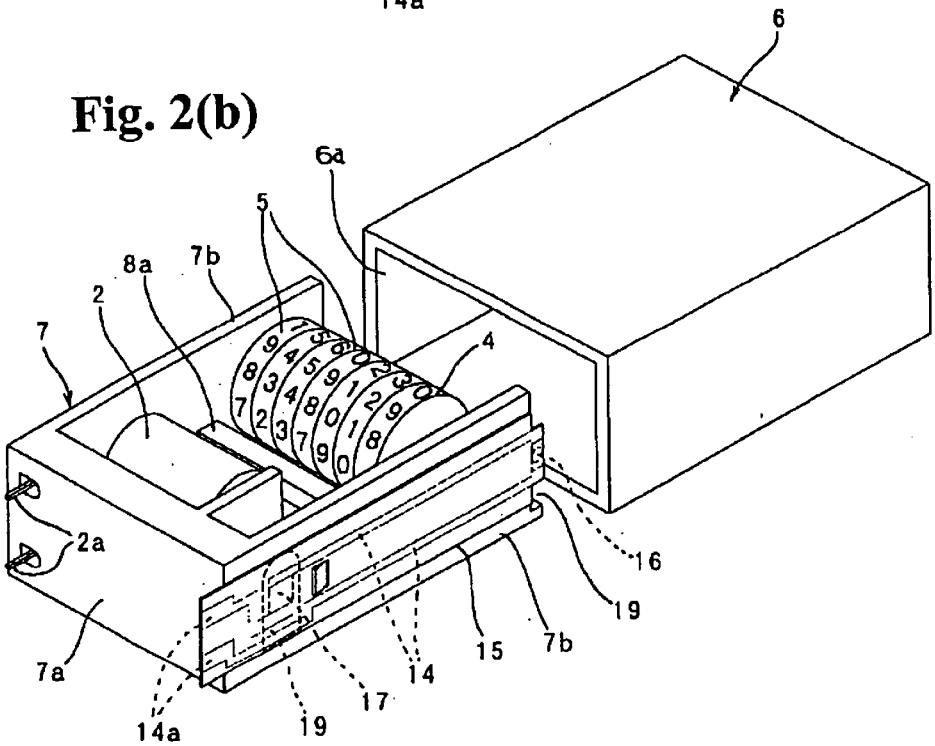

As shown in FIGS. 2(*a*) and 2(*b*), the flexible board 15 is formed in a roughly rectangular shape, and is attached to the side section 7*b* of the frame member 7. The printed wiring 14 is formed between the light emitting diode 16 mounted at one end and the end terminal sections 14*a* formed on the other end, and the current limiting resistor 17 is mounted at an intermediate section.

In the electromagnetic counter described above, the electromagnet 2, anchor 3, lowest digit number wheel 4, and upper digit number wheels 5 are assembled on the frame member 7 to form the electromagnetic counting mechanism in advance. The flexible board 15 with the light emitting diode 16 and current limiting resistor 17 mounted thereon is attached to the side section 7*b* of the frame member 7 with the double-sided tape, so that the light emitting diode 16 and current limiting resistor 17 are housed in the notches 19, and the cover member 6 covers the frame member 7. Accordingly, the flexible board 15 with the light emitting diode 16 and current limiting resistor 17 mounted thereon is housed in the confined space 20 between the frame member 7 and cover member 6. Therefore, even if the counter has an extremely small size without a space for a miniature light bulb, it is possible to install the illumination means for easily reading the counter in a dark location. The illumination means includes the light emitting diode 16, so that no maintenance is required, and even if the case 1 is difficult to disassemble, there is no effect on the actual use. Further, as described above, it is easy to install the electromagnetic counter in the equipment. Therefore, the electromagnetic counter is extremely useful for installing in a compact game machine, a copier, a printer and the like.

Figure 4A:
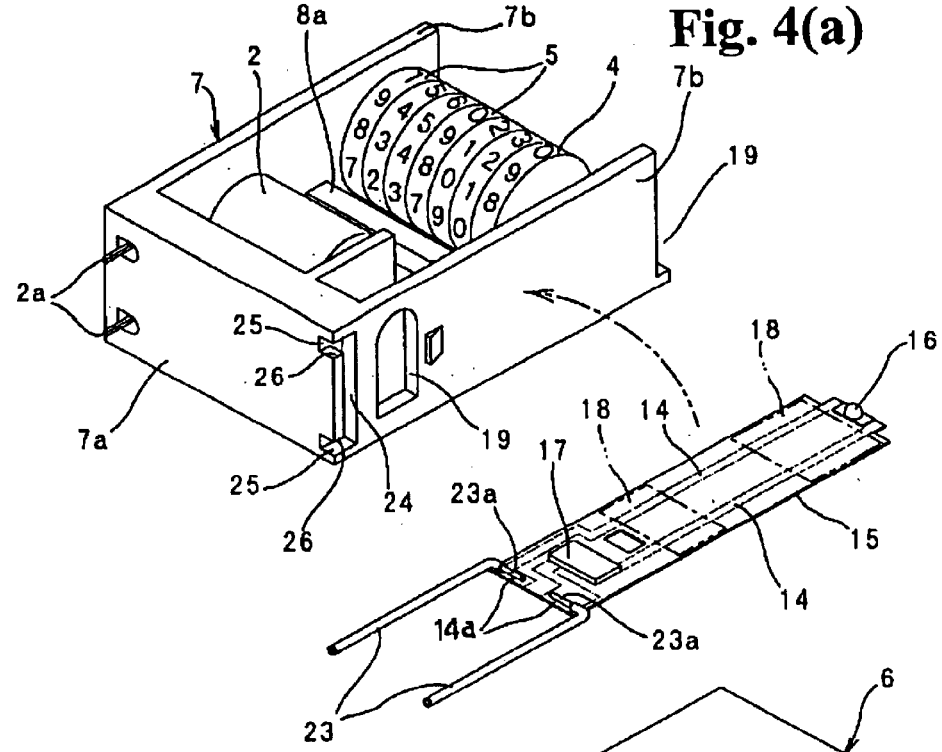
FIGS. 4(*a*) and 4(*b*) are views showing an electromagnetic counter according to another embodiment of the present invention, wherein FIG. 4(*a*) is a perspective view of a state in which a cover member and a flexible board of the electromagnetic counter are removed, and FIG. 4(*b*) is a perspective view showing a state before the cover member and frame member are assembled.
Figure 4B:
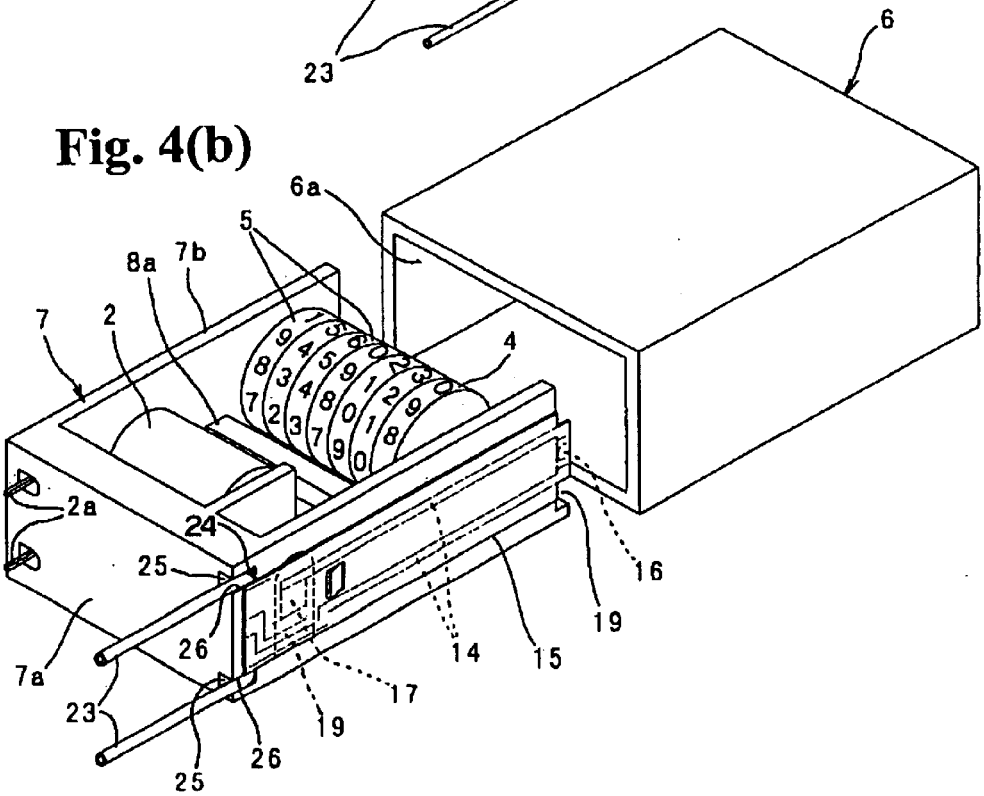

FIGS. 4(*a*) and 4(*b*) show another embodiment in which the electromagnetic counter A described above is partially modified. The same reference numerals designate the same components as those previously described, and a part of explanations and illustrations is omitted. Only different aspects will be explained.

According to the embodiment, in the electromagnetic counter A, the end terminal sections 14*a* of the flexible board 15 are connected to lead wires 23 for supplying electrical power to the light emitting diode 16. The frame member 7 is provided with engaging grooves for engaging end sections 23*a* of the lead wires 23. The end sections 23*a* of the lead wires are soldered to the end terminal sections 14*a* of the printed wiring 14, and are fixed to the engaging grooves.

The engaging grooves are formed in a base end section of the side section 7*b* of the frame member 7 to which the flexible board 15 is attached. The engaging grooves include engaging corner sections 26 having horizontal grooves 24 extending perpendicular to the printed wiring 14, and longitudinal grooves 25 extending outside the base section 7*a* from both ends of the horizontal grooves 24. The end sections 23*a* of the lead wires 23 are inserted into the horizontal grooves 24, and are soldered to the end terminal sections 14*a* of the printed wirings 14 in a state in which the end sections 23*a* are inserted into the longitudinal grooves 25 while bending at roughly a right angle. Accordingly, since the lead wires 23 are firmly fixed to the engaging corner sections 26, even if an external force is applied in a direction of pulling out the lead wires 23, the soldered connections between the lead wire end sections 23*a* and the end terminal sections 14*a* of the printed wiring 14 are not disconnected.

Figure 5A:
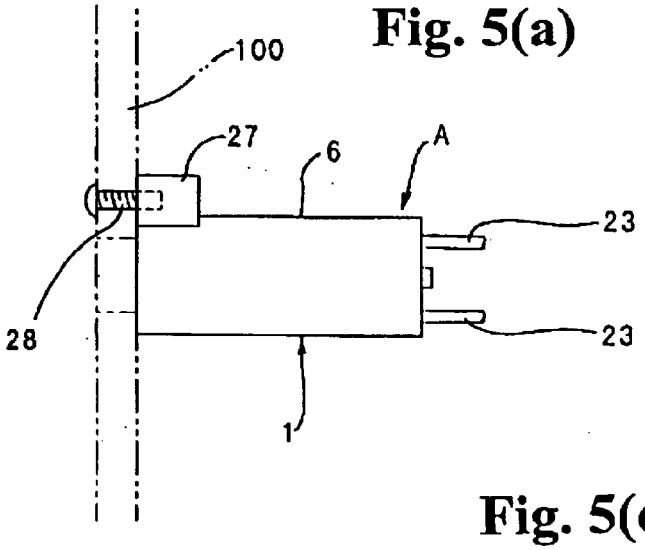
FIGS. 5(*a*) to 5(*c*) are side views showing the electromagnetic counter shown in FIGS. 4(*a*) and 4(*b*) in a mounted state.
Figure 5C:
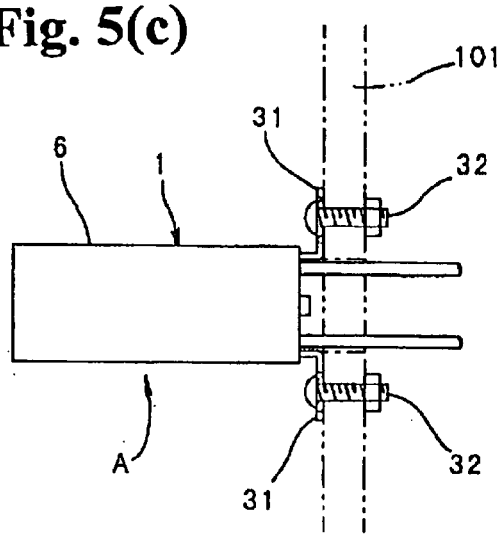
Figure 5B:
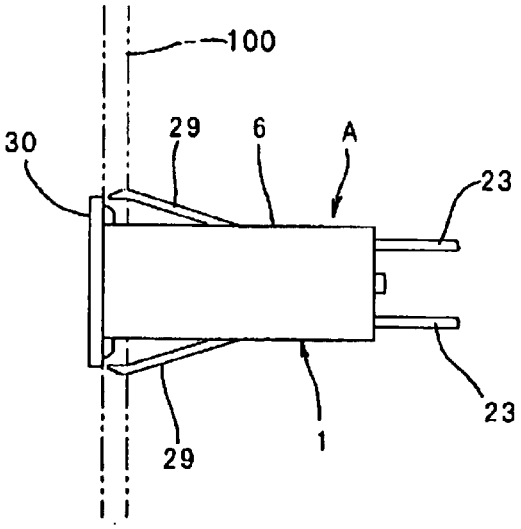

Examples of mounting structures in which the electromagnetic counter A of the present embodiment are mounted to equipment are shown in FIGS. 5(*a*) to 5(*c*). FIG. 5(*a*) shows a case in which a mounting section 27 is integrated with a front side (counter display side) of the cover member 6, and is fastened to a front panel 100 of equipment with a bolt 28. FIG. 5(*b*) shows a case in which the electromagnetic counter A is inserted into the front panel 100 with upper and lower clips 29 and flange 30 integrated with the front side of the cover member 6. FIG. 5(*c*) shows a case in which L-shaped mounting brackets 31 are integrated with a backside of the cover member 6, and are fastened to the mounting panel 101 with the bolts 32.

Figure 6A:
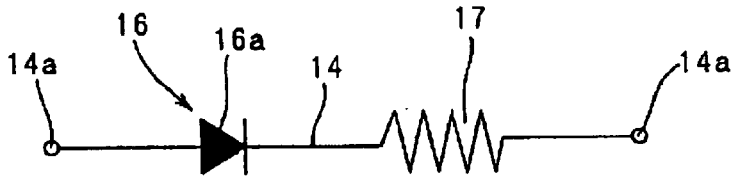
FIGS. 6(*a*) to 6(*c*) are circuit diagrams of a flexible board, wherein FIG. 6(*a*) is a view showing a case of mounting a monochromatic light emitting diode, FIG. 6(*b*) is a view showing a case of mounting a two-color light emitting diode, and FIG. 6(*c*) is a view showing a case of mounting a three-color light emitting diode.
Figure 6B:
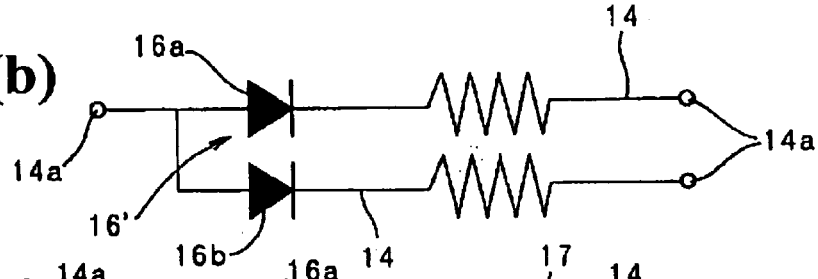
Figure 6C:
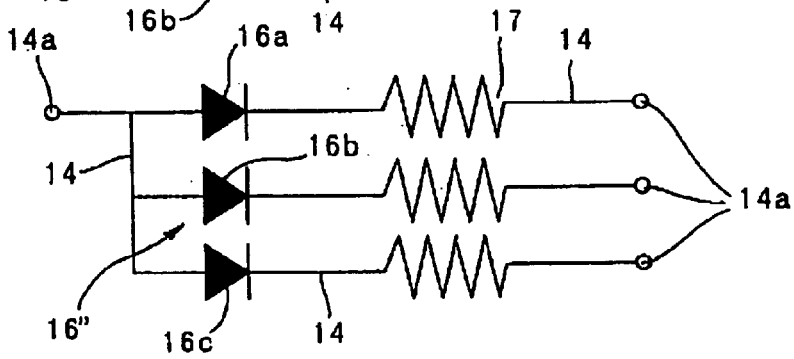

FIGS. 6(*a*)–6(*c*) show variations of the light emitting diode 16 in the embodiments described above. In the electromagnetic counter A described above, the light emitting diode 16 mounted on the flexible board 15 is a monochromatic light emitting diode having a single light emitting element 16*a* in a circuit diagram as shown in FIG. 6(*a*). Alternatively, it is possible to use a multicolor light emitting diode 16' having two light emitting elements 16*a* and 16*b* of different colors in a circuit diagram as shown in FIG. 6(*b*). It is also possible to use a multicolor light emitting diode 16" having three light emitting elements 16*a*, 16*b* and 16*c* of different colors in a circuit diagram as shown in FIG. 6(*c*).

When such multicolor light emitting diodes 16' and 161 are used, the voltage applied to the end terminal sections 14*a* of the printed wiring 14 is adjusted to allow one or a plurality of the light emitting elements to illuminate an arbitrary color or colors, so that the emitted light (illumination color) of the multicolor light emitting diodes 16' and 16" can be suitably selected.

Figure 7:
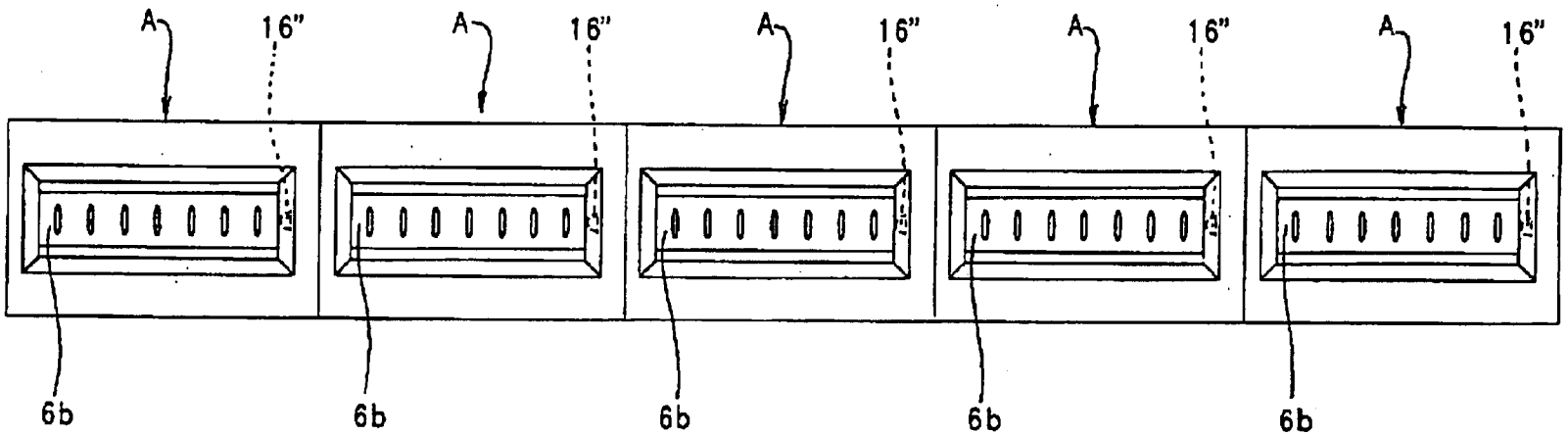
FIG. 7 is a front view showing a state in which a plurality of electromagnetic counters is installed.

With this configuration, as shown in FIG. 7, a plurality of the electromagnetic counters A may be installed to accommodate a plurality of count elements. In this case, the multicolor light emitting diodes 16" may have different colors for each of the counters A, so that it is easy to distinguish each of the counters A, thereby eliminating reading error in the count elements, improving accuracy of the count data and performing the counting with high reliability.

As described above, the embodiments of the present invention have been explained with reference to the drawings. The electromagnetic counter of the present invention is not limited to the embodiments shown in the drawings. It is possible to provide various modifications within the technical scope of the invention.

While the invention has been explained with reference to the specific embodiments of the invention, the explanation is illustrative and the invention is limited only by the appended claims.

What is claimed is:

1. An electromagnetic counter comprising:

a case having a frame member and a cover member for covering the frame member, an electromagnet disposed in the case, an anchor disposed adjacent to the electromagnet to be rotatable through magnetization and demagnetization of the electromagnet, a number wheel connected to the anchor and rotating at a predetermined angle according to a rotation of the anchor, and a flexible board disposed in the case and having a light emitting diode for illuminating the number wheel, wherein said frame member is equipped with the electromagnet, the anchor and the number wheel, and said flexible board is arranged in a confined space between the frame member and the cover member.

2. An electromagnetic counter according to claim 1, wherein said frame member includes a notched portion for retaining the light emitting diode, said flexible board being attached to a surface of the frame member.

3. An electromagnetic counter according to claim 2, further comprising a circuit board formed on one side of the frame member where the electromagnetic counter is attached.

4. An electromagnetic counter according to claim 3, wherein said cover member includes an opening for inserting the frame member, and said frame member includes a base section for closing the opening, and two side sections extending from two sides of the base section to form a U-shape so that the electromagnet, the anchor and the number wheel are disposed between the two side sections; said electromagnet includes a connection terminal protruding outward through the base section; and said flexible board is attached to one of the side sections, and includes an end section protruding outside the base section and an end terminal section formed of a printed wiring connected to the light emitting diode at the end section thereof, said end terminal being fixed to wiring of the circuit board.

5. An electromagnetic counter according to claim 2, wherein said cover member includes an opening for inserting the frame member, and said frame member includes a groove, a base section blocking the opening, and two side sections extending from two sides of the base section so that the electromagnet, the anchor and the number wheel are disposed between the two side sections, said flexible board being attached to one of the side sections and having a printed wiring and a wiring engaging the groove and connected to the printed wiring.

6. An electromagnetic counter according to claim 1, wherein said light emitting diode includes a plurality of light emitting diodes illuminating different colors.

* * * * *